United States Patent [19]

Reinhall

[11] 4,082,233

[45] Apr. 4, 1978

[54] DISC REFINER HAVING MEANS FOR REMOVING GASEOUS MEDIA FROM PULP STOCK

[76] Inventor: Rolf Bertil Reinhall, 834, 171 Place NE., Bellevue, Wash. 98008

[21] Appl. No.: 690,955

[22] Filed: May 28, 1976

[30] Foreign Application Priority Data

Jun. 4, 1975 Sweden ..... 7506421

[51] Int. Cl.[2] ..... B02C 7/11

[52] U.S. Cl. ..... 241/244; 241/247

[58] Field of Search ..... 241/244, 245, 246, 247, 241/259.1, 259.2, 259.3

[56] References Cited

U.S. PATENT DOCUMENTS

| | | | |
|---|---|---|---|
| 2,561,043 | 7/1951 | Ayers | 241/245 X |
| 3,441,227 | 4/1969 | Fisher | 241/244 UX |
| 3,845,909 | 11/1974 | Johansson | 241/247 X |
| 3,847,363 | 11/1974 | Reinhall | 241/245 |

FOREIGN PATENT DOCUMENTS

| | | | |
|---|---|---|---|
| 2,442,627 | 3/1975 | Germany | 241/245 |

*Primary Examiner*—Roy Lake
*Assistant Examiner*—Howard N. Goldberg
*Attorney, Agent, or Firm*—Eric Y. Munson

[57] ABSTRACT

A grinding apparatus in which lignocellulosic material is ground between a pair of discs which rotate relatively to one another in a pressurized housing. The stock is advanced by means of a screw feeder, through a central opening in the disc housing and introduced into the grinding space between the discs under maintenance of the pressure within the housing. Excessive high-pressure steam or other gas generated during the grinding process is separated from the ground stock, which is returned to the grinding space by centrifugal force, while the steam or other gas freed of stock particles is discharged without interfering with the stock inflow.

5 Claims, 3 Drawing Figures

12
14
39
37
16
30
31
22
20
35
23
28
33
100
41
21
43
24
45
26
27
42
42
26
25
40
44
29
50
102
51
49
46
34
32
38
36

DISC REFINER HAVING MEANS FOR REMOVING GASEOUS MEDIA FROM PULP STOCK

BACKGROUND OF THE INVENTION

This invention relates to a device for defibering fibrous material. More particularly this invention relates to a device in grinding apparatus for lignocellulose containing material which have grinding discs housed rotatably relatively to one another in a pressurized grinding casing, the surfaces of said grinding discs facing one another and defining therebetween a grinding interspace into which the stock to be ground is fed through a central supply passage. A pressurized gaseous medium such as steam or other treating gas is present in the interspace or generated therein during the grinding process with consequent higher pressure than in the passage. The device according to the invention can also be used where initially produced fiber pulps are treated in a subsequent grinding process to desired processing degree.

THE PRIOR ART

It is known in the art that in grinding wood chips and the like in one or several steps to a final product for use in the manufacture of paper, for example, whether in the presence of, or in the absence of chemicals, best result is obtained when the grinding operation is carried out with such limited addition of water that the temperature in the grinding procedure will rapidly reach 100° C or even a higher temperature, if the system is totally or partly sealed off from the ambient atmosphere. Common to all these so-called high concentration grinding processes is the feature that energy supplied during the grinding process is converted into friction forces between the various grinding surfaces and the stock to be ground passing therebetween. These friction forces result in the stock being heated to a degree which corresponds substantially to the supplied energy, and when the temperature of the grinding produce or stock exceeds the boiling point corresponding to the pressure maintained in the grinding apparatus, a corresponding amount of steam is generated. This more or less strong steam generation often creates flow conditions in the grinding apparatus which interfere with the stock inflow to the refiner which causes variations in the refiner load with consequent detrimental effect on the pulp quality. This is especially the case in grinding apparatus of the type generally known as disc refiners in which a relatively narrow grinding space between the discs must be maintained in order to obtain complete disintegration of the stock and the required pulp quality.

The steam generated between the grinding discs and the increased pressure developed as a consequence often is higher than the pressure prevailing generally in the grinding apparatus and results in one portion of the steam being forced outwards towards the outlet side of the grinding discs while at the same time another portion of the generated steam flows back towards the feed opening and penetrates into the material to be ground. How much of the generated steam which flows outward or backward depends in each case on the construction of the grinding discs and the predetermined spacing between the opposed surface of the discs.

In grinding apparatus which are operated at atmospheric pressure as well as superatmospheric pressure, the amount of steam flowing against the advancing stream of stock interferes with and often interrupts uniform feed of stock to the grinding discs. In cases where the stock is introduced into the grinding apparatus by means of a feed screw through the inlet opening of the grinding discs, increased supply of energy often creates such steam pressures that the introduction of the stock is rendered exceedingly difficult. The high steam pressures also cause relatively great quantities of untreated stock to accompany the escaping steam and thus substantially complicate the control of the feed of stock to the grinding discs. These high steam pressures also make it difficult uniformly to distribute any added water or chemicals which may be required for the disintegration process.

MAIN OBJECTS OF THE INVENTION

One main object of the present invention is to provide means in grinding or defibration apparatus of the disc type whereby the aforesaid disadvantages are minimized.

Another object of the invention is to provide a disc type pulp refiner having means permitting excess generated steam and other gaseous media to be separated from stock and removed from the refiner without interfering with stock inflow into the refiner. A further object of the invention is to utilize the removed steam or other gaseous treating media for pre-treatment of the stock or for other heating purposes.

SUMMARY OF THE INVENTION

According to one main feature of the invention, a channel is provided for removing gaseous media, such as steam or treatment gases flowing backwards from the interspace towards the feed-in end which channel is partitioned from the central supply passage. Steam or gas separating means rotate along with the grinding disc and have apertures or slots which emerge in the feed-in zone through which the stock is introduced into the grinding space. One or more of said apertures or slots are formed to impart to the gaseous medium streaming into the feed-in zone a rotative movement so that particles of the stock to be ground carried along with the gaseous medium are separated off by the resultant centrifugal force and returned to the grinding interspace.

BRIEF DESCRIPTION OF THE DRAWINGS

Further objects and advantages with, and characteristic features of, the invention will become apparent from the following description in connection with the accompanying drawings which form part of this specification and of which.

DETAILED DESCRIPTION OF THE PREFERRED EMBODIMENT

Figure 1:
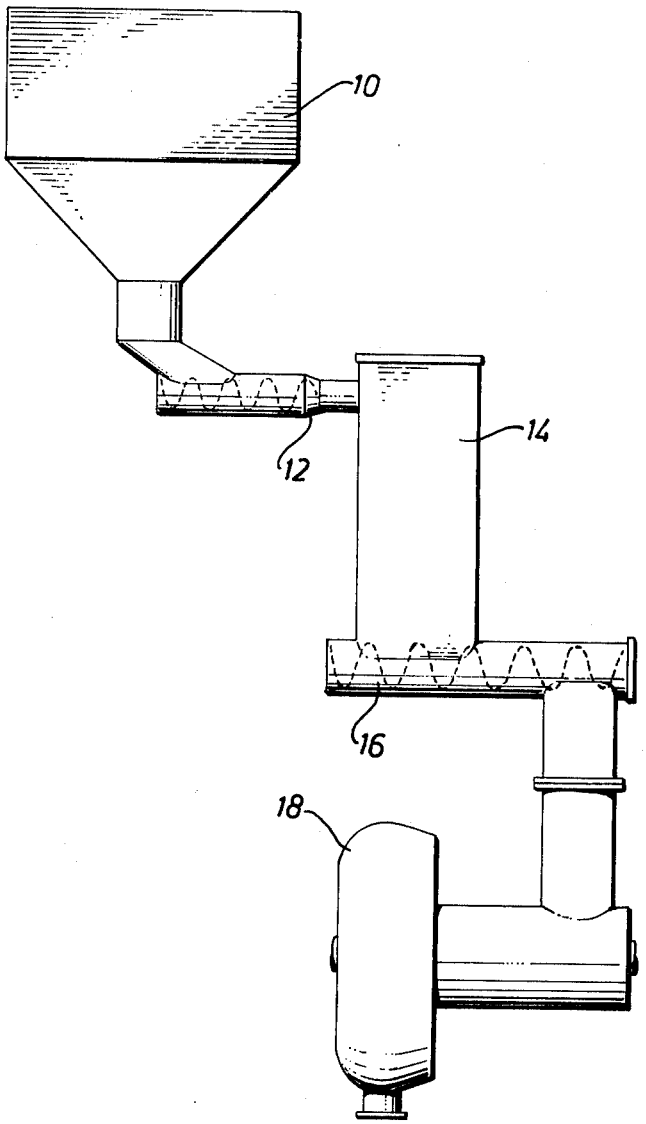
FIG. 1 is a diagrammatic view of a grinding apparatus of the disc refiner type with associated equipment constructed according to the invention.
Figure 2:
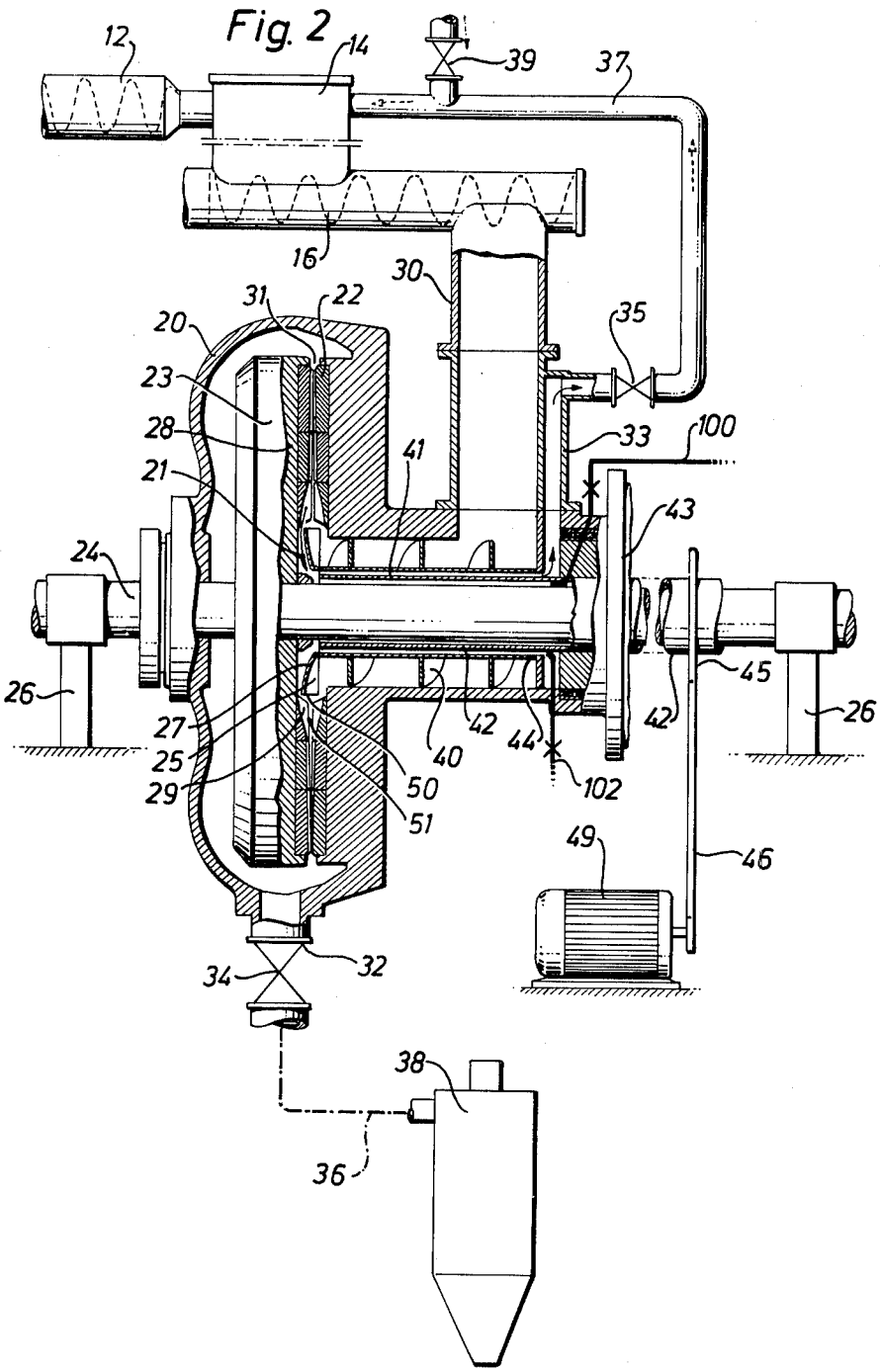
FIG. 2 is a vertical sectional view drawn to a larger scale of the disc refiner shown in FIG. 1 and certain parts of the equipment belonging thereto.
Figure 3:
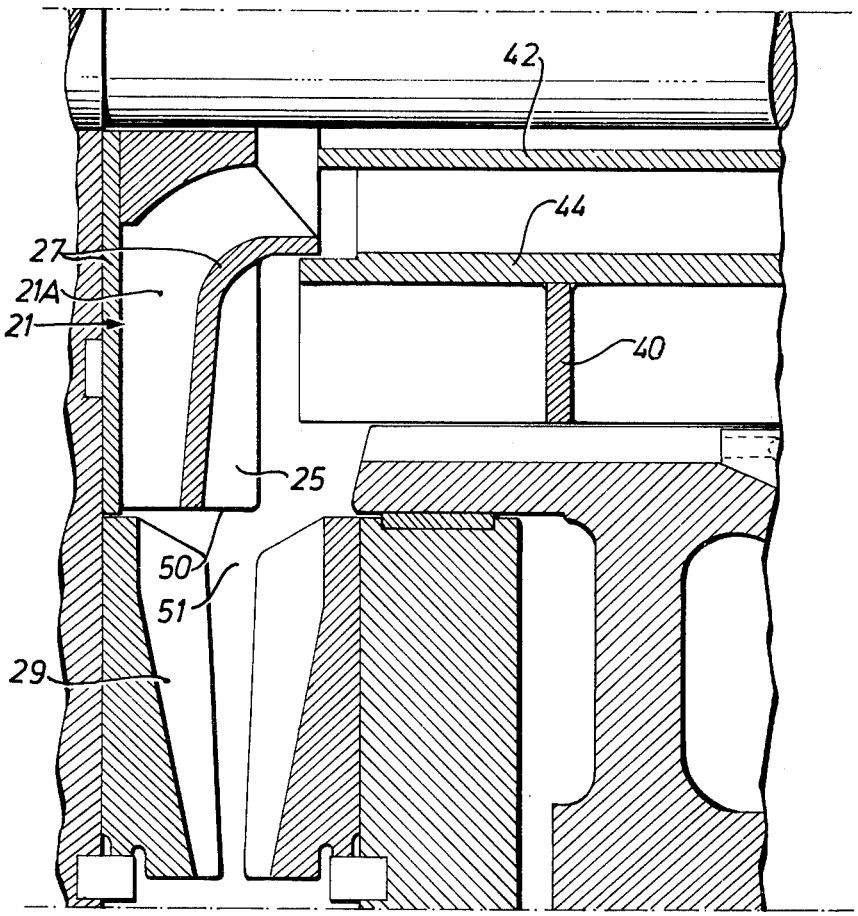
FIG. 3 is a sectional view drawn to still a larger scale of a detail of the central portion of the grinding discs.

Referring to the drawings, a grinding apparatus of the disc refiner type as shown in FIG. 1 is generally denoted 18. Reference numeral 10 designates a storage container for the starting material such as wood in disintegrated shape, also called wood chips. By a feeding device 12, such as a feeder screw, the starting material is introduced into a vessel 14 which is maintained under elevated pressure, the feed device 12 sealing said elevated pressure within the vessel. The vessel 14, which is used for preheating of the material, is at its bottom through a conveyor screw 16 connected to the grinding apparatus 18 which comprises a closed housing 20 (FIG. 2) within which is mounted a stationary grinding disc 22 and a rotatable grinding disc 28 mounted on a common shaft 24 in a base frame 26. The starting material supplied by the conveyor screw 16 is introduced into a vertical inlet tube 30 which in a pressure-tight manner is connected to the grinding housing 20 and which with its lower end portion opens into a screw conveyor 40 by which the material is fed into the grinding apparatus 18. The screw conveyor 40 emerges through a central opening at the inner periphery of an interspace or gap 31 defined between the two grinding discs 22 and 28. While the shaft 24 may have a relatively high rotational speed such as 1800 r.p.m., the number of revolutions of the screw conveyor 40 is substantially lower, such as 150 r.p.m. only.

The grinding housing 20 surrounding the grinding discs has in the shown embodiment at its bottom an outlet 32 which is equipped with a blow-off valve 34 by which the discharge flow area of the outlet is controlled. The outlet 32 is for example through a duct 36 connected with a centri-cleaner or cyclone 38 for separation of the steam accompanying the ground and discharged product. Said steam can in known manner be utilized for e.g. preheating the treated material or for production of warm water etc.

The screw conveyor 40 is carried on a tubular sleeve 42 mounted concentrically about the drive shaft 24. The tubular sleeve 42 carries in turn a further concentrical tubular sleeve 44 on which the screw thread or other feeding members are provided. The outer tubular sleeve 44 opens at its forward end into the housing 20 of the grinding apparatus with a minimal open gap towards a discharge or ejector and separating rotor 27 mounted on a rotor 23 and formed with outer blades or wings 25 for discharge the ground produce and inner blades 21A for cleaning the steam removed from the rotor. The tubular sleeve 44, which forms the shaft of the screw conveyor, and the screw thread 40 carried thereon are connected at its rear or inlet end to the inlet tube 30 for the stock to be ground whereas the interspace or passage 41 between the two concentrical tubular sleeves 42 and 44, opens into a steam removing channel 33 arranged adjacent the inlet tube 30. The steam abducting channel 33 has an outlet opening 35 through which drawn-off steam or other treatment gas can be returned to the vessel 14 for preheating the stock. The return is effected through a duct 37 to which is connected an inlet 39 for fresh steam with required control members mounted thereon and safety members for pressure control. The inner tubular sleeve 42 of the screw conveyor 40 extends through the housing of the channel 33 and is sealed by means of stuffing box 43 which carries at its outer end a sprocket 45 by means of which the sleeve 42 and thereby the screw conveyor 40 by a driving motor 49 through a chain 46 can be brought to rotate with a desired number of revolutions and to desired capacity. Addition of liquid desired for the process is effected through a pipe 100 opening into the space between the drive shaft 24 and the inner tubular sleeve 42 or through a bent pipe 102 opening a distance into the space between the inner tubular sleeve 42 and the outer tubular sleeve 44, i.e. into that space which is utilized for abduction of the steam.

The blades 25 are carried by the ejector and separator rotor 27 which, as already mentioned, is disposed on the rotor 23 and fits substantially to discharge ridges or blades 29 provided on the grinding discs. The outer periphery 50 of the rotor 27 is in direct communication with the space 51 for discharging the stock into the grinding interspace 31 between the grinding discs 22, 28. Formed behind the blades 25 on the ejector rotor 27 is an annular gap or clearance 21 with one or several ejector blades 21A disposed therein in a generally radial direction. This annular clearance channel or gap 21 is provided with blades 21A is connected to the interspace 41 between the outer and inner tubular sleeves 42, 44 of the screw conveyor for removal and simultaneous centrifugal cleaning of excess of treating gas, such as steam, from the space 51 from which the stuff to be ground enters the grinding interspace 31.

To sum up: According to the present invention there is obtained, when the material or stock to be ground is introduced by the screw conveyor 40 into the space 51, a removal of at least a portion of the steam quantity formed in said space 51 and the grinding interspace 31 into the steam discharge channel 33. This discharge is effected through the clearance or channel portion 21 provided with blades and formed in the ejector rotor 27 or between the same and the rotor 23, subsequently through the interspace 41 between the pressure sealed sleeve 44 of the screw conveyor and the inner shaft sleeve 42 of the same to the steam removal channel 33, from which the steam or the like gaseous medium passes through the pipe 37 into a centri-cleaner or to the preheater 14. In the preheater the steam is used for preheating of the starting material present therein prior to the feeding thereof into the refiner. In the removal of steam or other treating gaseous medium, stock to be ground accompanying said medium is separated off by the centrifugal force generated in the neighbourhood of the separator rotor 27 by the rotation of the blades 21A and is returned to the discharge ridges 29 and the grinding interspace 31.

While one more or less specific embodiment of the invention has been shown and described, it is to be understood that this is for purpose of illustration only, and that the invention is not to be limited thereby, but its scope is to be determined by the appended claims.

What is claimed is:

1. In a disc-type defibrating apparatus in which lignocellulose pulp stock is ground in a grinding space between the discs which are mounted on a drive shaft to rotate relatively to one another in a housing containing a pressurized gaseous medium and into which the stock is advanced in a feed-in passage from an inlet to a feed-in opening by conveyor means rotating in a feed-in passage, the improvement which provides separation of excessive high pressure gaseous medium from the gas and stock mixture and permits discharge of the liberated purged gaseous medium without interference with the inflow of stock, said improvement comprising:

a. centrifuging means in said feed-in opening separating excessive high pressure gas from said mixture and propelling the separated stock particles towards said grinding space while purging the liberated gaseous medium;

b. channel means partitioned from said feed-in passage for withdrawing the liberated purged gaseous medium from said feed-in opening;

c. said centrifuging means comprising at least one impeller member for producing the centrifugal force required for the separation process;

d. said channel means being defined between two concentric sleeves (42, 44) co-axially surrounding said drive shaft and being rotatable relative thereto: and e. said conveyor means being supported by the outer one of said sleeves.

2. A defibrating apparatus according to claim 1, in which the outer one of said sleeves (44) rotatably engages said centrifuging means (27).

3. A defibrating apparatus according to claim 2, in which the inner sleeve (42) is spaced from the drive shaft to define a passage for introduction of a liquid into said grinding space.

4. A defibrating apparatus according to claim 2, in which means (102) are provided for introducing liquid into said channel means for withdrawing the gaseous medium and to be conveyed to said grinding space by the centrifugal force exerted by centrifuging means.

5. A defibrating apparatus according to claim 4, in which said centrifuging means is rotated by said drive shaft on the order of 1800 rpm., and said sleeve members and conveyor means are rotated on the order of 150 rpm.

* * * * *